United States Patent [19]

Milne

[11] Patent Number: 4,982,947

[45] Date of Patent: Jan. 8, 1991

[54] APPARATUS FOR DETECTING THE PASSAGE OF MULTIPLE SUPERPOSED SHEETS ALONG A FEED PATH

[75] Inventor: Douglas L. Milne, Dundee, Scotland

[73] Assignee: NCR Corporation, Dayton, Ohio

[21] Appl. No.: 268,442

[22] Filed: Nov. 8, 1988

[30] Foreign Application Priority Data

Mar. 30, 1988 [GB] United Kingdom ..... 8807631

[51] Int. Cl.[5] ..... B65H 7/12

[52] U.S. Cl. ..... 271/263; 271/262; 364/563

[58] Field of Search ..... 271/263, 262, 258, 259, 271/265, 274, 303, 176; 209/604, 603, 534; 364/562, 563, 560; 902/16

[56] References Cited

U.S. PATENT DOCUMENTS

| | | | |
|---|---|---|---|
| 3,778,051 | 12/1973 | Allen et al. | 271/262 |
| 4,154,437 | 5/1979 | Butcheck et al. | 271/6 |
| 4,159,782 | 7/1979 | Swartzendruber | 221/1 |
| 4,168,058 | 9/1979 | Granzow et al. | 271/5 |
| 4,398,711 | 8/1983 | Horst et al. | 271/263 |
| 4,426,785 | 1/1984 | Loftus et al. | 33/147 L |
| 4,462,587 | 7/1984 | Graef et al. | 271/263 |
| 4,491,929 | 1/1985 | Ikoma et al. | 364/563 |
| 4,506,880 | 3/1985 | Dixon et al. | 271/263 |
| 4,815,015 | 3/1989 | Milne | 364/563 |
| 4,894,783 | 1/1990 | Milne | 364/563 X |

FOREIGN PATENT DOCUMENTS

| | | |
|---|---|---|
| 0130825 | 6/1984 | European Pat. Off. . |
| 0186442 | 12/1985 | European Pat. Off. . |
| WO82/01698 | 5/1982 | PCT Int'l Appl. . |
| 2001038A | 7/1978 | United Kingdom . |

OTHER PUBLICATIONS

U.S. Ser. No. 094,986, filed Sep. 10, 1987, assigned to NCR Corporation, entitled, "Apparatus for Detecting the Passage of Multiple Superposed Sheets along a Feed Path", Douglas L. Milne.

U.S. Ser. No. 245,200, filed Sep. 16, 1988, assigned to NCR Corporation, entitled, "Apparatus for Detecting the Passage of Multiple Superposed Sheets along a Feed Path", Douglas L. Milne.

*Primary Examiner*—David H. Bollinger

*Attorney, Agent, or Firm*—Wilbert Hawk, Jr.; Albert L. Sessler, Jr.; Elmer Wargo

[57] ABSTRACT

A linear variable differential transformer (42) produces an output voltage which varies linearly with movement of the axis of a movable axis roller (14) relative to the axis of a fixed axis roller (12) brought about by the passage of a sheet between the rollers. Circuits (154, 189) store a reference voltage representative of a minimum value of the output voltage during one revolution of the fixed axis roller, and subtracting circuits (162, 172) subtract the reference voltage from the output voltage when a single or multiple sheet is passing between the rollers so as to produce a difference value representative of the thickness of this sheet. A processor (178) samples the difference value a plurality of times during one revolution of the fixed axis roller, and provides an indication that a multiple sheet has passed between the rollers if at least a predetermined number of consecutive samples of the difference value exceed a predetermined value.

8 Claims, 6 Drawing Sheets

LVDT
42
LVDT SIGNAL CONDITIONER
112
152
150
SAMPLE AND HOLD
154
156
MINIMA DETECTOR
180
DIFFERENTIAL AMPLIFIER
162
170
ANALOG TO DIGITAL CONVERTER
172
CONVERT
176
174
SAMPLE
196
MICROPROCESSOR
178
214
218
228
ATM PROCESSOR
212
210
TIMING DISC SENSOR
60
NOTE PRESENT SENSOR
62
NOTE PICKED SENSOR
110
220
226
224
MOTOR
56
MOTON
216
DIVERT SOLENOID
102
DIVERT
230
PICK MECHANISM
70
PICK
222

[redacted] amount of money. For convenience, two or more sheets or notes which have become disposed in a superposed relationship will hereinafter be referred to as a multiple sheet or a multiple note.

One known type of apparatus for detecting the passage of multiple notes along a feed path employs a note thickness sensing mechanism through which notes are fed in operation and which incorporates a gauging roller. In the event of a multiple note (or an excess thickness note) passing through the sensing mechanism, the axis of the gauging roller is displaced by an amount such that a note rejecting means is actuated, actuation of the rejecting means causing the notes or note to be diverted into a reject hopper. A problem experienced with known apparatuses of this type is that such apparatus may not distinguish between multiple notes and a single note having a localized increase in thickness, brought about for example by a crease or fold in the note or by the attachment thereto of extraneous matter such as adhesive tape. As a result, there is a tendency for such apparatus to reject an excessive number of notes. The use of such apparatus in a cash dispensing mechanism of an ATM would tend to increase maintenance costs, since the rejection of an excessive number of notes would decrease the period of time between successive replenishments of the machine with currency notes.

An apparatus which is intended to overcome the aforementioned problem is disclosed for example in U.K. Patent Application No. 2,001,038A. A thickness sensor including a pair of gauging rollers is arranged to gauge a portion of a currency note and to generate a digital signal in response to note thickness. For example, a logic 1 signal in response to a multiple note thickness and a logic 0 signal in response to a single note thickness may be used. The digital output of the thickness sensor is applied to an integrator circuit which integrates this output over substantially the entire length of the gauged portion of the note. The output of the integrator circuit is compared with a reference signal in order to determine if the gauged note is a multiple note or a single [redacted] age during one complete revolution of one of said rollers when no sheet is passing between said first and second rollers, the diameter of said one of said rollers being equal to, or greater than, the diameter of the other roller, subtracting means for subtracting said reference voltage from said output voltage when a single or multiple sheet is passing between said first and second rollers so as to produce a difference value representative of the thickness of said single or multiple sheet, and data processing means coupled to said subtracting means for providing an indication that a multiple sheet has passed between said first and second rollers if said difference value continuously exceeds a predetermined value for a period corresponding to at least a predetermined proportion of one complete revolution of said one of said rollers.

BRIEF DESCRIPTION OF THE DRAWING

A preferred embodiment of the present invention will now be described, by way of example, with reference to the accompanying drawing, in which.

Figure 3:
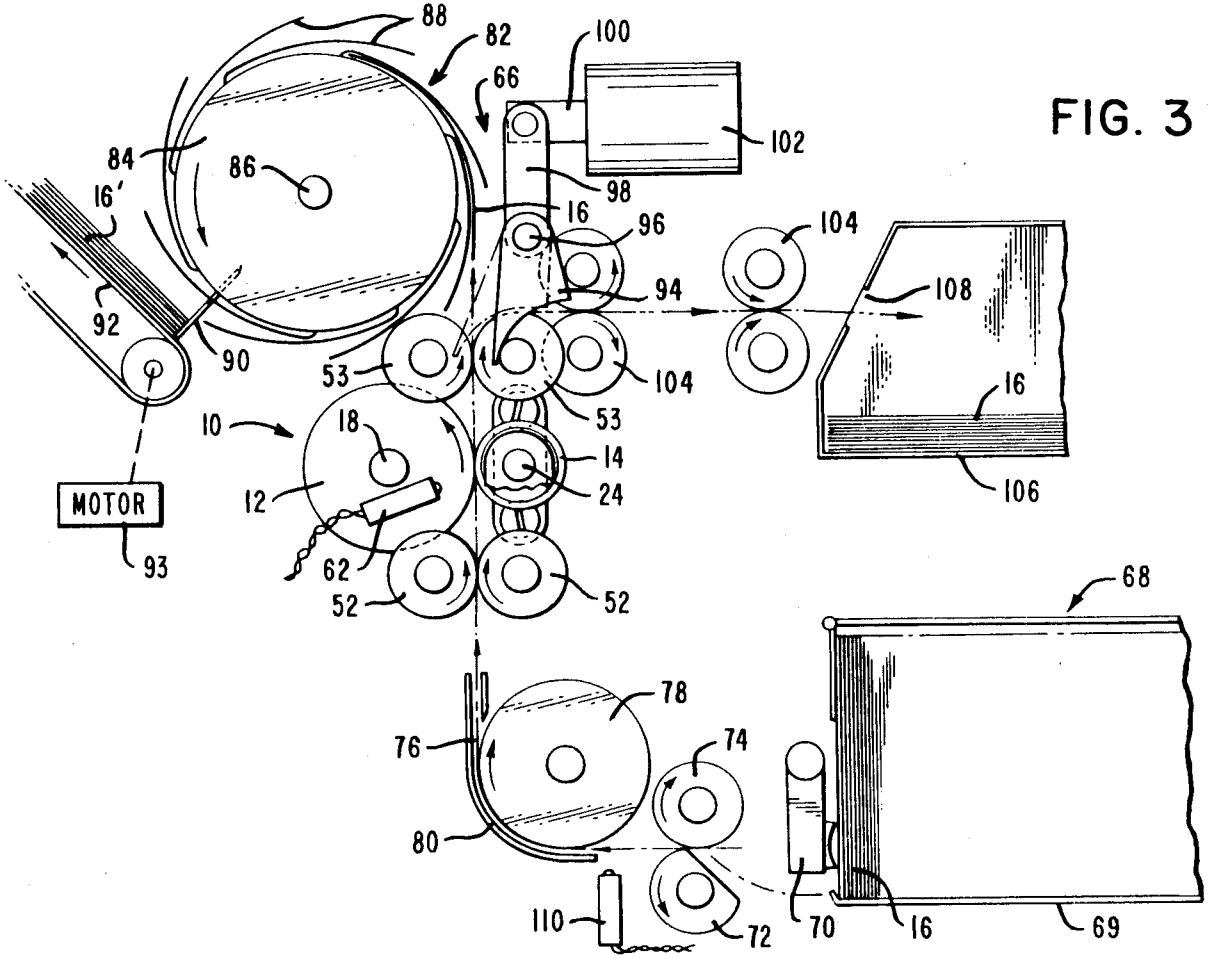
FIG. 3 is a schematic view of part of a cash dispensing mechanism incorporating the note sensing mechanism of FIGS. 1 and 2.

of a comb-like structure, and the tines 88 of each stacking plate 84 are arranged to pass between adjacent teeth of the stripper plate 90. In operation, each currency note 16 fed by the feed rolls 53 to the stacking wheel 82 enters between adjacent tines 88 of the stacking plates 84, as shown in FIG. 3, and is carried partly around the axis of the stacking wheel 82, the note 16 being stripped from the stacking wheel 82 by the stripper plate 90 and being stacked against a normally stationary belt 92 with a long edge of the note 16 resting against the stripper plate 90. When a bundle of notes 16' (or possibly a single note only) to be dispensed to a user of the ATM in response to a cash withdrawal request has been stacked on the belt 92, the belt 92 is operated by a separate motor 93 so as to transport the bundle of notes 16' towards a cash delivery slot (not shown).

A divert gate 94 (FIG. 3) mounted on a shaft 96 is positioned above the note sensing mechanism 10 in association with the feed rolls 53. One end of an arm 98 is secured to the shaft 96, the other end of the arm 98 being pivotally coupled to an armature 100 associated with a solenoid 102. As will be explained later, the solenoid 102 is arranged to be energized in response to the multiple note detect apparatus detecting that a multiple note has passed through the note sensing mechanism 10. The arrangement is such that with the solenoid 102 in a non-energized condition, the divert gate 94 is in the position shown in solid outline in FIG. 3, out of the feed path 76 of currency notes 16 from the guide roller 78 to the stacking wheel 82. Upon the solenoid 102 being energized, the armature 100 causes the divert gate 94 to be pivoted via the arm 98 and shaft 96 in a clockwise direction into the position shown in dashed outline in FIG. 3 in which the divert gate 94 is positioned in the feed path 76. With the divert gate 94 in this last-mentioned positioned, the divert gate 94 serves to guide multiple notes to feed rolls 104 which feed the notes to a reject bin 106, the notes being deposited into the bin through a slot 108.

In addition to the optical sensor 62 (FIG. 3) which is arranged to sense the entry of a currency note 16 into the nip of the rollers 12 and 14, the cash dispensing mechanism 66 also includes an optical sensor 110 which is arranged to sense when a currency note 16 has been extracted from the cassette 68 by the pick mechanism 70 and associated roll means 72 and 74.

Figure 1:
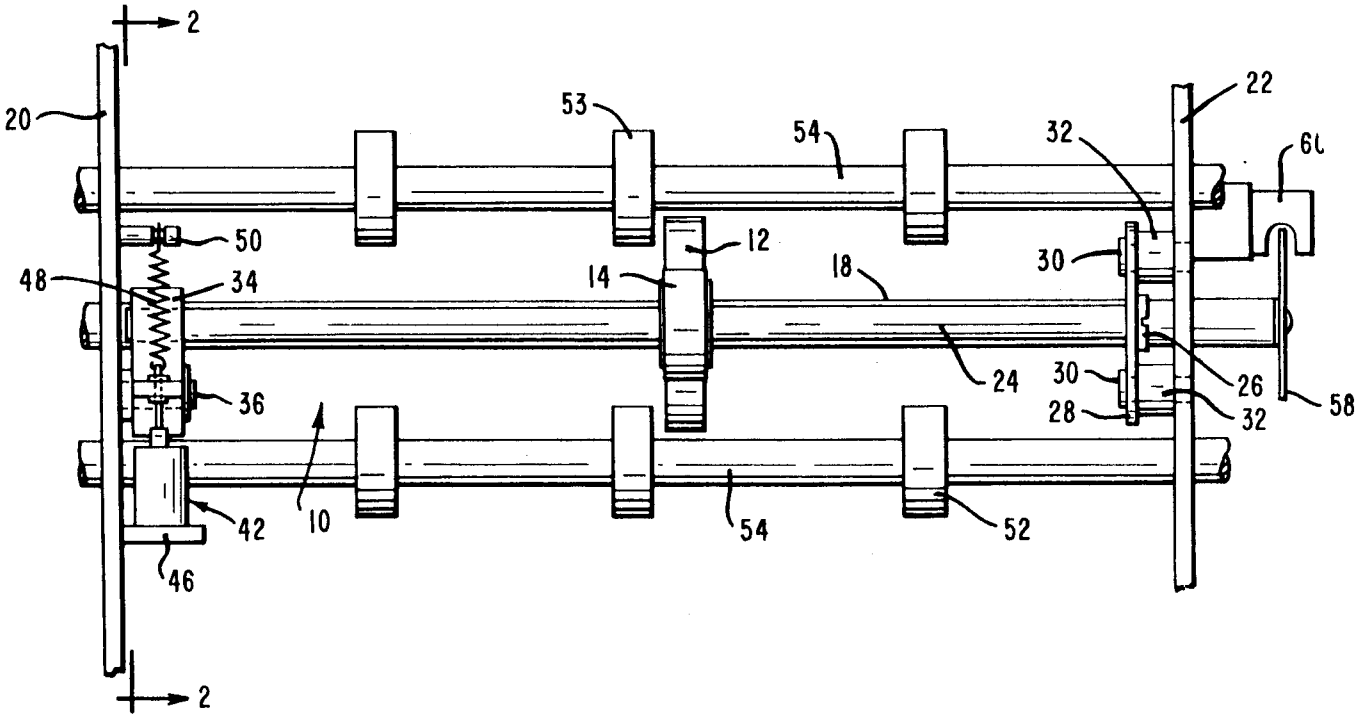
FIG. 1 is a front elevational view of a note sensing mechanism utilized in a multiple note detect apparatus in accordance with the present invention.
Figure 2:
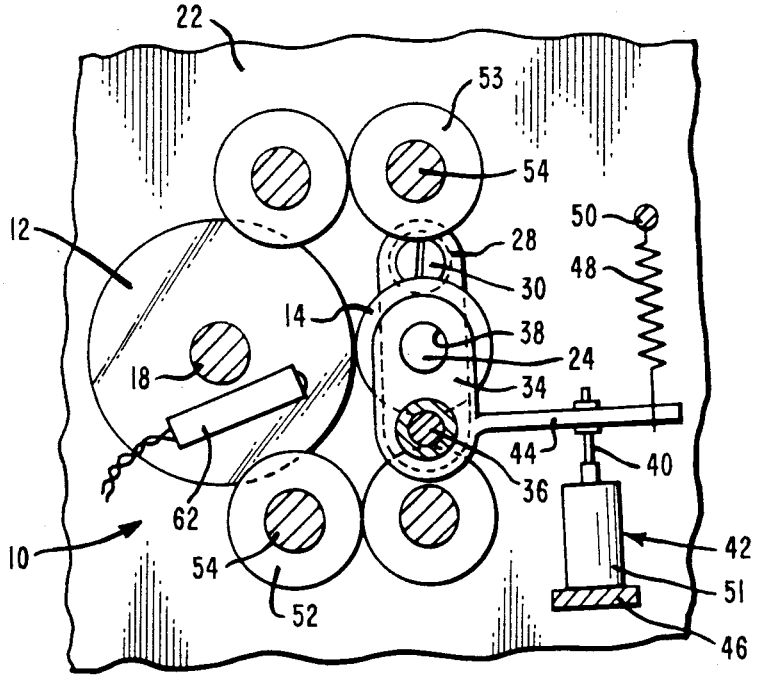
FIG. 2 is a part sectional side elevational view of the note sensing mechanism of FIG. 1 taken along the line 2—2 of FIG. 1.
Figure 4A:
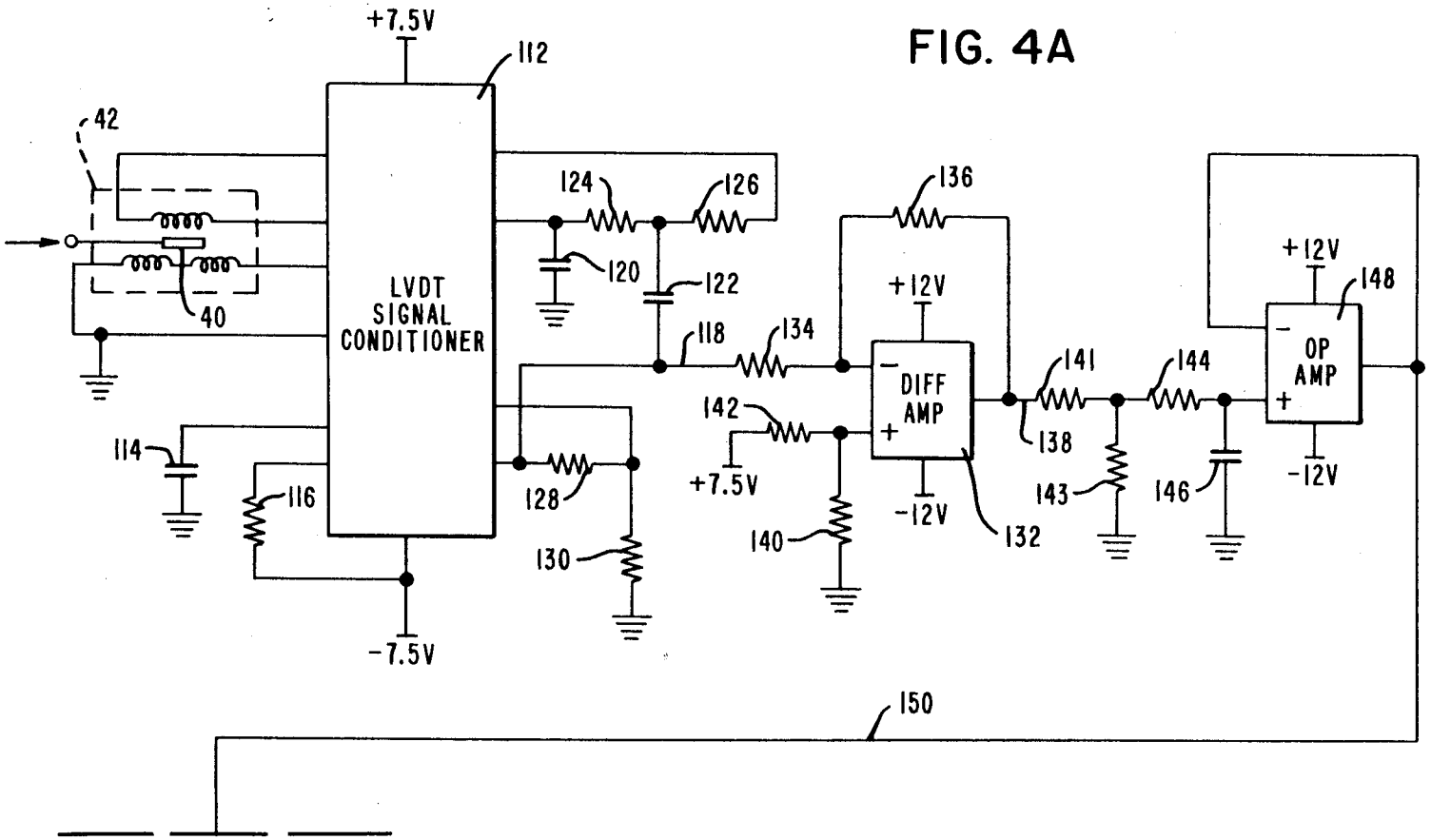
FIGS. 4A and 4B together form a circuit diagram of means for generating a reference voltage and a difference value representing the thickness of a sensed note.

Referring now to FIG. 4A, the LVDT 42 is connected to an LVDT signal conditioner 112 such as model NE 5521 available from Mullard Limited, London. As is known, the signal conditioner 112 is in the form of an integrated circuit incorporating: a low distortion, amplitude stable sine wave oscillator with programmable frequency for driving the primary winding of the LVDT 42; a synchronous demodulator for converting the LVDT output amplitude and phase to position information; and an output amplifier for providing amplification and filtering of the demodulated signal. A capacitor 114 and a resistor 116 set the modulation frequency of the primary winding of the LVDT 42 at 14 KHz. The output of the signal conditioner 112 appears on an output line 118, the demodulator output of the signal conditioner 112 being connected to the output line 118 via a low pass filter comprising capacitors 120 and 122 and resistors 124 and 126 connected as shown in FIG. 4A, and the gain of the output of the signal conditioner 112 being set by resistors 128 and 130. In the embodiment described, the output voltage appearing on the line 118 changes from +5 volts to −5 volts as the armature 40 moves into the LVDT 42 from its uppermost position to its lowermost position, as viewed in FIG. 2. The output line 118 of the signal conditioner 112 is connected to the negative terminal of a differential amplifier 132 via a resistor 134, this terminal being connected via a resistor 136 to the output line 138 of the amplifier 132. The positive terminal of the amplifier 132 is connected to ground via a resistor 140 and is connected to a +7.5 volts supply via a resistor 142. The differential amplifier 132 serves to change the +5 volts to −5 volts output of the signal conditioner 112 into a 0 to +10 volts swing on the line 138. The line 138 is connected via a voltage divider comprising resistors 141 and 143 and an RC filter comprising a resistor 144 and a capacitor 146 to the positive terminal of an operational amplifier 148, the negative terminal of which is connected to the output line 150 of the amplifier 148. The voltage divider 140, 142 serves to limit the output swing of the amplifier 132 to a 0 to +5 volts swing, and the combination of the RC filter 144, 146 and the operational amplifier 148 serves as a low pass filter to remove the effect of the low frequency mechanical oscillations of the LVDT armature 40 brought about by the return spring 48 (FIGS. 1 and 2). Thus, it will be appreciated that the signal appearing on the line 150 is a DC voltage between 0 and +5 volts which varies linearly with movement of the armature 40 into and out of the LVDT 42 and which therefore also varies linearly with angular movement of the axis of the roller 14 towards and away from the axis of the roller 12 (FIGS. 1–3).

Figure 4B:
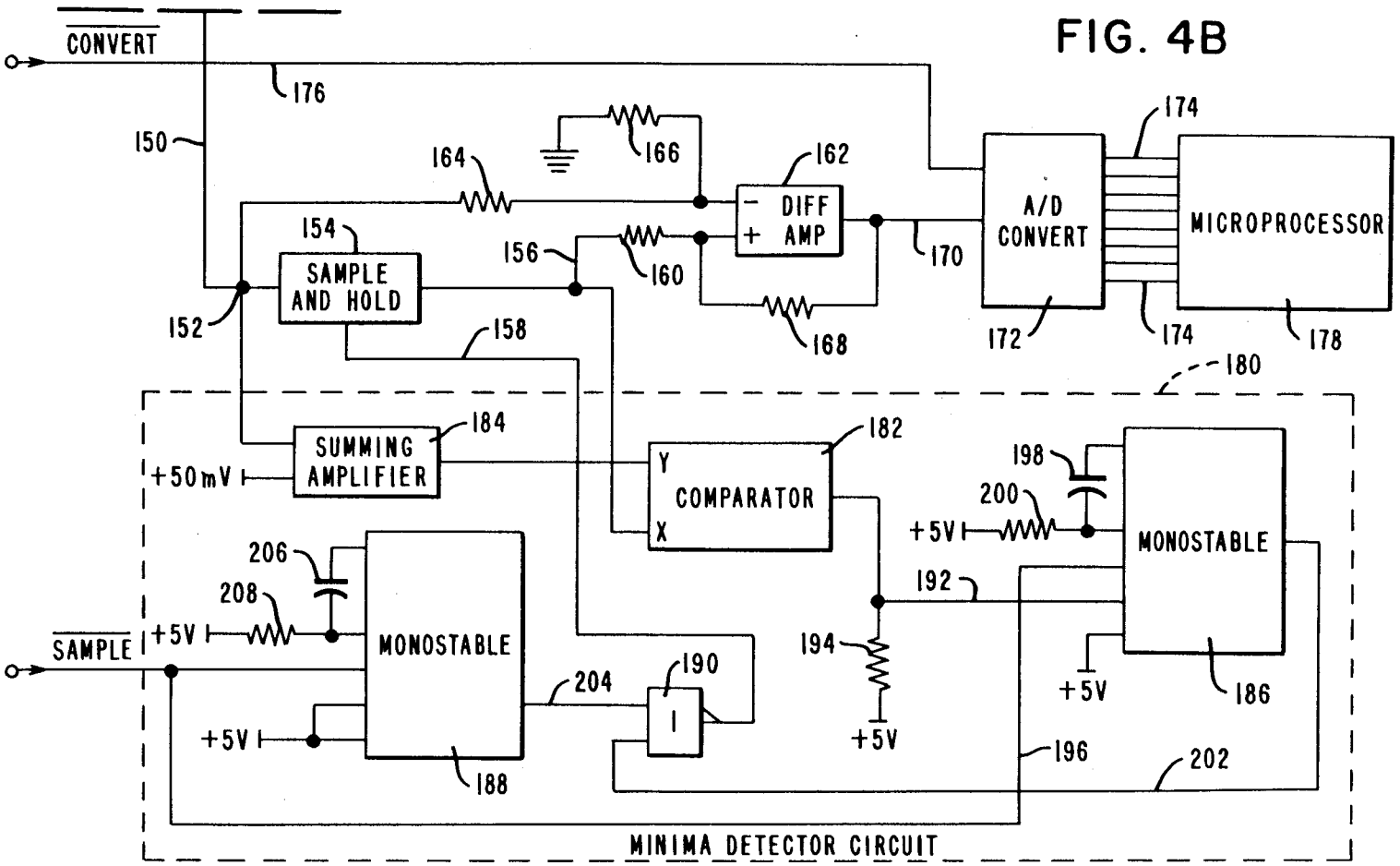

Referring now to FIG. 4B, the line 150 is connected via a node 152 to the input of a conventional sample and hold circuit 154, the output terminal of which is connected to a line 156 and a control terminal of which is connected to a line 158. In response to a high level pulse applied to its control terminal on the line 158, the sample and hold circuit 154 operates in well-known manner to store at its output terminal the voltage level appearing at its input terminal. The line 156 is connected via a resistor 160 to the positive input terminal of a differential amplifier 162, and the node 152 is connected via a resistor 164 to the negative input terminal of the differential amplifier 162. The negative and positive input terminals of the differential amplifier 162 are respectively connected via resistors 166 and 168 to ground and to an output line 170 connected to the output of the differential amplifier 162.

The output line 170 (FIG. 4B) is connected to a first input of an analog-to-digital (A/D) converter 172 which serves to convert the voltage appearing on the line 170 to an 8-bit digital word, the bits of which respectively appear on the output lines 174 of the A/D converter 172. A control line 176 is connected to the A/D converter 172, and the operation of the converter 172 is controlled by a control signal CONVERT applied to the line 176. A "" after a control signal is read as a "Bar" signal; for example, CONVERT is read as CONVERT "Bar". An analog-to-digital conversion takes place in response to the signal CONVERT going low for a period of approximately 50 microseconds. The output lines 174 are connected to a microprocessor 178, such as an 8049 microprocessor available from Intel Corporation, the microprocessor 178 being arranged to process the information appearing on the lines 174 in a manner to be described later.

The sample and hold circuit 154 (FIG. 4B) is associated with a minima detector circuit 180 which includes a voltage comparator 182, a summing amplifier 184, first and second integrated monostable circuits 186 and 188 of type 74LS123, and a negative logic OR gate 190. The output of the summing amplifier 184 is connected to a first (Y) input terminal of the voltage comparator 182, and the input terminals of the summing amplifier 184 are respectively connected to the node 152 and to a +50 mV voltage supply. A second input terminal (X) of the comparator 182 is connected to the output line 156 connected to the output of the sample and hold circuit 154. If the voltage level appearing at the Y terminal of the comparator 182 falls below the voltage level stored at the output of the sample and hold circuit 154 and applied to the X terminal of the comparator 182, then the output of the comparator 182 changes from a high state to a low state. Since one of the terminals of the summing amplifier 184 is connected to a +50 mV voltage supply, the voltage derived from the LVDT 42 and appearing on the line 150 must fall below the level stored at the output of the sample and hold circuit 154 by more than 50 mV before the output of the comparator 182 changes from a high state to a low state.

The output of the comparator 182 is connected to a line 192 which is connected via a resistor 194 to a +5V voltage supply and which is also connected to a first input terminal of the monostable circuit 186. A second input terminal of the monostable circuit 186 is connected to a line 196, a third input terminal is connected to a +5V voltage supply, and fourth and fifth input terminals are connected together via a capacitor 198, the fourth input terminal being additionally connected via a resistor 200 to a +5V voltage supply. When the signal on the line 92 changes from a high level to a low level, then, provided that a low level signal SAMPLE is present on the line 196, the monostable circuit 186 will generate a low level pulse of 50 microseconds on a line 202 connected to the output of the monostable circuit 186. The values of the capacitor 198 and the resistor 200 determine the width of the pulse generated on the line 202. The line 202 is connected to one input of the OR gate 190, a second input of the OR gate 190 being connected to a line 204 connected to the output of the monostable circuit 188. A first input terminal of the monostable circuit 188 is connected to the line 196, second and third input terminals are connected to a 5V voltage supply, and fourth and fifth input terminals are connected together via a capacitor 206, the fourth input terminal being additionally connected via a resistor 208 to a +5V voltage supply. Upon the low level signal SAMPLE appearing on the line 196, the monostable circuit 188 will cause a high level pulse of 50 microseconds to be generated on the line 204, the values of the capacitor 206 and the resistor 208 determining the width of this pulse. The output of the OR gate 190 is connected to the control line 158 which is connected to the control terminal of the sample and hold circuit 154. If the monostable circuit 186 causes a low level pulse to be generated on the line 202 or if the monostable circuit 188 causes a low level pulse to be generated on the line 204, then a high level pulse will appear at the output of the OR gate 190 on the line 158, this last-mentioned pulse causing the sample and hold circuit 154 to store at its output the voltage level appearing on the line 150.

Figure 5:
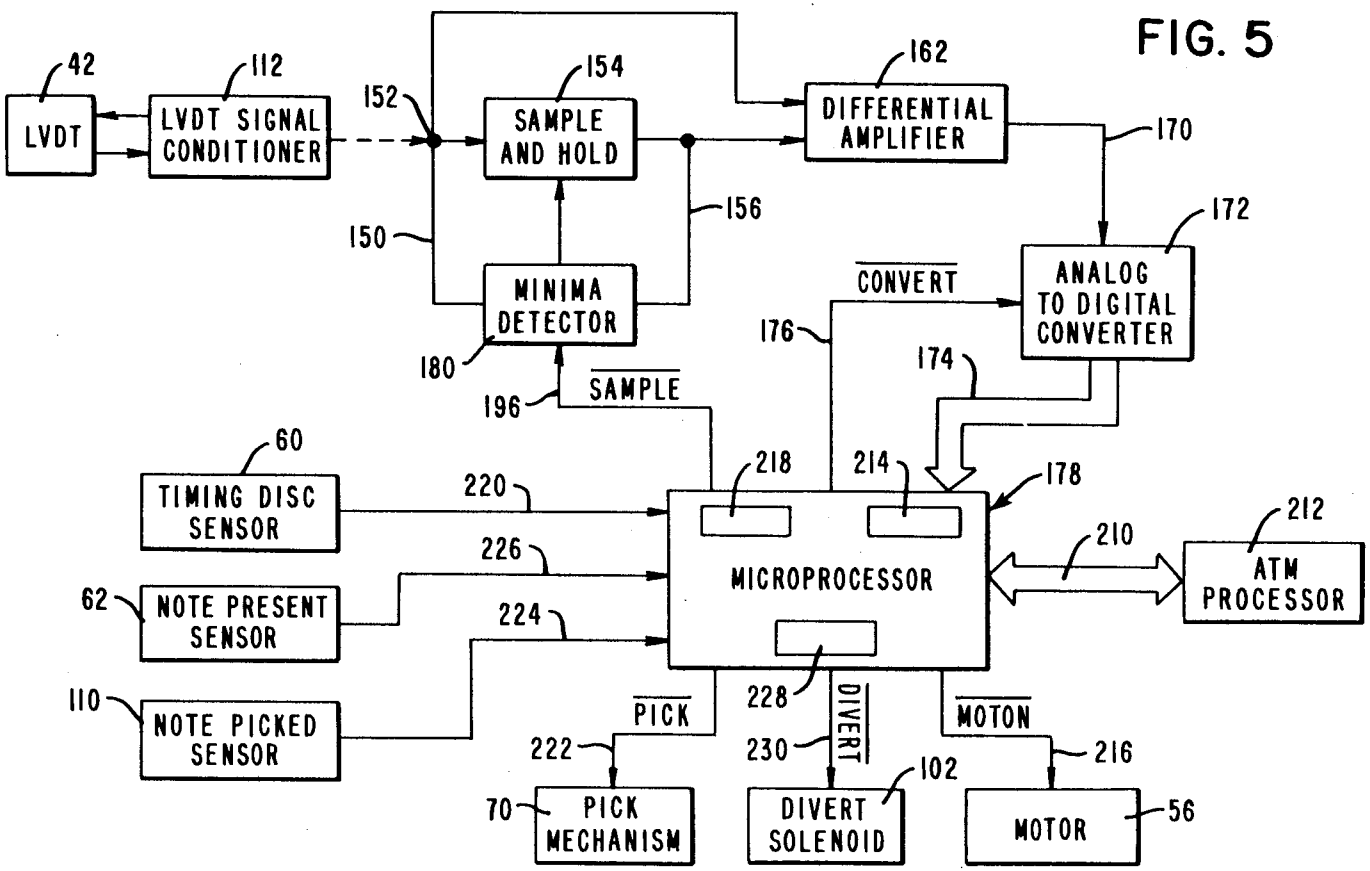
FIG. 5 is a block circuit diagram of the multiple note detect apparatus and associated parts of the cash dispensing mechanism.

The operation of the multiple note detect apparatus and of the associated parts of the cash dispensing mechanism 66 will now be described with additional reference to FIG. 5. This operation is controlled by the microprocessor 178 which is connected via an 8-bit bus 210 to the main ATM processor 212. When the main ATM processor 212 requests that a particular number of currency notes be dispensed by the cash dispensing mechanism 66 from the currency cassette 68 (FIG. 3) in response to a cash withdrawal request by the user of the ATM, the microprocessor 178 stores this number in an internal memory location 214. The microprocessor 178 then switches on the motor 56 by setting a control signal MOTON on line 216 low. It should be understood that the motor 56 controls the operation of the drive shaft 18, the feed rolls 52, 53 and 104, the cooperating rolls means 72, 74, the roller 78 and the stacking wheel 82.

The microprocessor 178 (FIG. 5) then causes the sample and hold circuit 154 and the minima detector circuit 180 to store at the output of the sample and hold circuit 154 a reference voltage which is representative of the minimum value of the voltage which appears on the line 150 during one complete revolution of the fixed axis roller 12 with no notes present between the rollers 12 and 14.

This operation is initiated by the microprocessor 178 (FIG. 5) generating the low level signal SAMPLE on the line 196, this signal having a duration corresponding to one complete revolution of the roller 12. The microprocessor 178 incorporates a counter 218, and the microprocessor 178 determines the duration of the signal SAMPLE by counting timing pulses applied to the microprocessor 178 by the timing disc sensor 60 over a line 220. In response to the signal SAMPLE being applied to the monostable circuit 188, a high level pulse will appear at the output of the OR gate 190 (FIG. 4B) and will be applied to the control terminal of the sample and hold circuit 154 via the line 158, thereby causing the sample and hold circuit 154 to store at its output the voltage level which is then appearing on the line 150. The voltage stored at the output of the sample and hold circuit 154 is applied via the line 156 to the X input terminal of the voltage comparator 182, this voltage being compared by the comparator 182 with the voltage applied to its Y input terminal by summing amplifier 184. The last-mentioned voltage is equal to the voltage appearing on the line 150 plus 50 mV. If the voltage applied to the Y terminal of the comparator 182 falls below the voltage applied to the X terminal of the comparator 182, due, for example, to the line of contact between the rollers 12 and 14 moving from a dirty area to a clean or less dirty area on one or each of the rollers 12 and 14, then the output of the comparator 182 changes from a high state to a low state. Provided that the low signal SAMPLE is still present on the line 196 when the output of the comparator 182 thus changes, the monostable circuit 186 will cause a low level pulse to be generated on the line 202 which in turn causes a high level pulse to be applied to the control terminal of the sample and hold circuit 154 over the line 158. This last-mentioned pulse serves to retrigger the sample and hold circuit 154 so as to cause the circuit 154 to store at its output the voltage level now appearing on the line 150. Since the voltage level at the Y input terminal of the comparator 182 is now no longer lower than the voltage level at the X input terminal of the comparator 182, the output of the comparator 182 will return to the high state. If the voltage level on the line 150 should fall still further (by more than 50 mV) while the low signal SAMPLE is present on the line 196, then a further retriggering of the sample and hold circuit 154 will take place, resulting in the further reduced level of the voltage appearing on the line 150 being stored at the output of the sample and hold circuit 154. Once the roller 12 has completed a full revolution following the commencement of the signal SAMPLE, the signal on the line 196 will be set high, thereby inhibiting any further retriggering of the sample and hold circuit 154. It will be appreciated that the voltage level stored at the output of the sample and hold circuit 154 at the completion of said full revolution is representative of the minimum value of the voltage appearing on the line 150 during said full revolution. The signal on the line 196 will remain high for the remainder of the cash dispensing operation in the course of which the required number of notes 16 are picked from the cassette 68 by the pick mechanism 70 for delivery to the user of the ATM.

The circuitry described above is designed so that, when a currency note 16 passes between the rollers 12 and 14, the voltage level on the line 150 increases by approximately 1 volt. The inclusion of the summing amplifier 184 in the minima detector circuit 180 provides for a more reliable operation of the circuit 180, since the connection of one input of the summing amplifier 184 to the +50 mV voltage supply ensures that the voltage level at the Y input terminal of the voltage comparator 182 rises above the voltage level at the X input terminal of the comparator 182 when the sample and hold circuit 154 is triggered, thereby ensuring that the output of the comparator 182 returns to the high state. The 50 mV voltage offset introduced by the summing amplifier 184 is insignificant compared with the 1 volt per note change in the voltage level on the line 150, and is less than a typical voltage variation caused by dirt on the rollers 12 and 14.

Once a reference voltage value has been established at the output of the sample and hold circuit 154 (i.e. on line 156 in FIG. 5) as just described, the required number of currency notes 16 are then picked by the pick mechanism 70. This picking operation is initiated by the microprocessor 178 applying a low signal PICK to the pick mechanism 70 over a line 222, which in correct operation causes the required number of notes 16 to be picked, one by one, from the currency cassette 68 (FIG. 3) by the pick mechanism 70. Each picked note (which may be a multiple note if the pick mechanism 70 operates incorrectly) is detected by the sensor 110 which sends a signal to the microprocessor 178 over a line 224 (FIG. 5) advising the microprocessor 178 that a note has been picked.

The picked currency note 16 is fed by the cooperating roll means 72, 74 (FIG. 3) along the feed path 76 to the feed rolls 52, and after passing through the feed rolls 52 the leading edge of the picked note 16 is detected by the sensor 62 as it enters the nip of the rollers 12 and 14. Thereupon, the sensor 62 sends a signal to the microprocessor 178 over a line 226 (FIG. 5) advising the microprocessor 178 that a currency note 16 is entering said nip. It should be noted at this point that the voltage presently appearing on the line 150 is applied to the negative input terminal of the differential amplifier 162, while the stored reference voltage appearing on the line 156 is applied to the positive input terminal of the differential amplifier 162. Upon the picked note entering the nip of the rollers 12 and 14, the voltage on the line 150 will increase, and the output of the differential amplifier 162 will be equal to the voltage on the line 150 less the reference voltage on the line 156, the difference value represented by the output of the differential amplifier 162 being proportional to the thickness of the picked note 16. This difference value is applied to the A/D converter 172 over the line 170. The microprocessor 178 stores in a table in a memory location 228 a number of 8-bit digital words representing the maximum thicknesses of the different currency note types that are handled by the cash dispensing mechanism 66. Upon the microprocessor 178 being advised by a signal over the line 226 that a currency note 16 has entered the nip of the rollers 12 and 14, the microprocessor 178 causes a low level pulse CONVERT, having a duration of 50 microseconds, to be generated on the line 176 for each transition between black and clear regions on the timing disc 58 sensed by the sensor 60. Thus, 72 equally spaced low level pulses CONVERT are generated for one full revolution of the roller 12, each of these pulses being applied to the A/D converter 172 over the line 176. For each pulse CONVERT which it receives, the A/D converter 172 transmits to the microprocessor 178 over the lines 174 an 8-bit digital word representing the output of the differential amplifier 162. The microprocessor 178 compares each of the words which it receives over the lines 174 with the 8-bit digital word stored in the memory location 228 representing the maximum thickness of the type of currency note that has just been picked, and the microprocessor 178 provides an indication that a multiple note has been picked if the values represented by at least 12 consecutive words received over the lines 174 exceed the value represented by the just-mentioned word stored in the memory location 228; this indication is the generation of a low level signal DIVERT on a line 230 connected to the divert solenoid 102. In other words, having regard to the fact that 72 low level pulses CONVERT are generated for one complete revolution of the roller 12, a low level signal DIVERT is generated by one microprocessor 178 if the difference value represented by the output of the differential amplifier 162 continuously exceeds the maximum value of the thickness of the relevant currency note type as stored in the memory location 228 for at least a predetermined proportion (1/6) of one complete revolution of the roller 12. In the present embodiment, the roller 12 has a circumference of 90 millimeters, and so samplings of the thickness of a note 16 passing between the rollers 12 and 14 take place at intervals of 1.25 millimeters.

If the microprocessor 178 (FIG. 5) does not provide an indication that a multiple note has been picked in the course of the pick operation, this means that a single note 16 has been correctly picked from the currency cassette 68 by the pick mechanism 70, and this note 16 is allowed to travel on from the note sensing mechanism 10 to the stacking wheel 82 (FIG. 3) for stacking on the belt 92. At the same time, the counter 218 is reset to zero, and the contents of the memory location 214 are decremented by one, the memory location 214 now containing the number of notes still to be picked from the cassette 68 and stacked on the belt 92. Assuming that the contents of the memory location 214 are not zero, another pick operation then takes place by virtue of the low level signal PICKcontinuing to be present on the line 222. In the course of this further picking operation, another note 16 is picked from the currency cassette 68 and, provided that it is not sensed as being a multiple note, this note 16 is stacked on the belt 92. As in the case of the first note 16 picked, the counter 218 is reset to zero, and the contents of the memory location 214 are again decremented by one. Successive picking operations take place under the control of the microprocessor 178 in the manner just described until such time as the contents of the memory location 214 have been reduced to zero, at which time the microprocessor 178 terminates the low level signal PICK on the line 222 so as to terminate the operation of the pick mechanism 70. The bundle of notes 16' (FIG. 3) stacked at this time on the belt 92 comprises the total number of notes to be dispensed to the user of the ATM. The belt 92 is then operated by motor 93 so as to transport the bundle of notes 16' towards the cash delivery port (not shown) for collection by the user of the ATM, and the microprocessor 178 switches off the motor 56 by terminating the low level signal MOTON, and resets the counter 218. It should be understood that at the beginning of each cash dispensing operation a low level signal SAMPLE is generated on the line 196 for one complete revolution of the roller 12, thereby causing a reference voltage to be regenerated and stored at the output of the sample and hold circuit 154 prior to the first note 16 being picked by the pick mechanism 70.

If, in the course of a pick operation, a multiple note is sensed by the note sensing mechanism 10, with the result that the microprocessor 178 generates a low level signal DIVERT on the line 230, the divert solenoid 102 is activated by the signal DIVERT so as to cause the divert gate 94 to be pivoted from its normal position shown in solid outline in FIG. 3 to the position shown in dashed outline. Thus, in consequence of the signal DIVERT being sent to the divert solenoid 102, the picked multiple note is diverted into the reject bin 106 (FIG. 3). Thereafter, the counter 218 is reset to zero, and a further pick operation is initiated.

If desired, during idle periods of the cash dispensing mechanism 66, an examination can be made on any uneven build up of dirt on the rollers 12 and 14. This can be done by first generating and storing at the output of the sample and hold circuit 154 (FIG. a minimum reference voltage in the manner previously described with no note present between the rollers 12 and 14, and then during a further complete revolution of the roller 12, again with no note present between the rollers 12 and 14, utilizing the output of the differential amplifier 162 to provide an indication of the thickness of any localized dirt build up. If a determination is made by the microprocessor 178 that excessive uneven build up of dirt on the rollers 12 and 14 has taken place, then the main ATM processor 212 could cause a request to be displayed for the rollers 12 and 14 to be cleaned. It should be understood that an even build up of dirt on the rollers 12 and 14 will not affect the measurement of note thickness as represented by the output of the differential amplifier 162.

The multiple note detect apparatus described above has the advantage that, since one of the inputs of the differential amplifier 162 is a reference voltage derived from the output of the LVDT 42 when no note is present between the rollers 12 and 14, the initial position of the armature 40 of the LVDT 42 is not critical. Thus, the armature 40 does not require time consuming initial positioning, as would be the case if a fixed voltage were used as the reference voltage applied to the differential amplifier 162. Also, this arrangement substantially ensures that the apparatus is not affected by the inevitable gradual build up of dirt (ink, dust, etc.) on the rollers 12 and 14, thereby removing the need for some form of clearing device to be built into the roller mechanism. Moreover, there is no need to re-adjust the electronic circuitry regularly to compensate for roller wear.

Another important feature of the apparatus is that the use of the minima detector 180 (FIG. 5) ensures that the reference voltage used is not derived from an output of the LVDT 42 when the roller 14 is temporarily deflected from the roller 12, due to the presence of a localized area of dirt or other extraneous matter on one or other of the rollers 12 and 14; if the reference voltage were derived from such output, then the sampled outputs of the differential amplifier 162 when a currency note 16 is present between the rollers 12 and 14 would not provide an accurate indication of the thickness of the note.

A further important feature of the multiple note detect apparatus described above is that a note 16 passing between the rollers 12 and 14 will only be rejected if at least a predetermined number (12 in the present embodiment) of consecutive sampled outputs of the differential amplifier 162 are representative of a thickness greater than the maximum thickness of the relevant currency note type. This last-mentioned feature substantially avoids the possibility of a currency note 16 being rejected and diverted to the reject bin 106 merely because of localized areas of dirt or attachments, such as adhesive tape, on the note, or a fold at an edge of the note, or because of localized areas of dirt etc. on one or other of the rollers 12 and 14. By reducing the number of notes that are rejected unnecessarily, the period of time between successive replenishments of the currency cassette 68 can be increased, thereby decreasing the downtime of the ATM of which the cash dispenser mechanism 66 forms a part.

I claim:

1. An apparatus for detecting the passage of superposed sheets along a feed path, comprising:

first and second cooperating rollers, with said first roller having a fixed axis of rotation;

means for feeding sheets along said feed path between said first and second cooperating rollers;

means for mounting said second cooperating roller so that its axis is movable relative to the fixed axis of said first cooperating roller and so that said second cooperating roller is biased towards said first cooperating roller to enable said second cooperating roller to be displaced away from said first cooperating roller in response to a single or multiple sheet passing between said first and second cooperating rollers;

voltage generating means associated with said second cooperating roller and arranged to produce an output voltage which varies linearly with movement of the axis of said second cooperating roller towards or away from the fixed axis of said first cooperating roller;

circuit means for storing a reference voltage representative of a minimum value of said outputvoltage during one complete revolution of one of said first and second cooperating rollers when no sheet is passing between said first and second cooperating rollers, the diameter of said one of said first and second cooperating rollers being equal to, or greater than, the diameter of the other one of said first and second cooperating rollers;

subtracting means for subtracting said reference voltage from said output voltage when a single or multiple sheet is passing between said first and second cooperating rollers so as to produce a difference value representative of the thickness of said single or multiple sheet; and data processing means coupled to said subtracting means for providing an indication that a multiple sheet has passed between said first and second cooperating rollers if said difference value continuously exceeds a predetermined value for a period corresponding to at least a predetermined proportion of one complete revolution of said one of said first and second cooperating rollers and for providing an indication that a single sheet with a fold or adhesive tape thereof, has passed between said first and second cooperating rollers if said difference value continuously exceeds said predetermined value for a period corresponding to less than said predetermined proportion of one complete revolution of said one of said first and second cooperating rollers.

2. The apparatus as claimed in claim 1, in which said data processing means has means to sample said difference value a plurality of times at equal intervals when a single or multiple sheet is passing between said first and second cooperating rollers; and also has means to provide an indication that a multiple sheet has passed between said first and second cooperating rollers if at least a predetermined number of consecutive samples of said difference value exceed said predetermined value.

3. The apparatus as claimed in claim 2, in which said apparatus also includes:

a rotatable timing member which is arranged to rotate in synchronism with said one of said first and second cooperating rollers; and sensor means arranged to generate a series of timing pulses in response to the rotation of said timing member, said sensor means being connected to said data processing means to enable said timing pulses to control the timing of the sampling of said difference value.

4. An apparatus for detecting the passage of superposed sheets along a feed path, comprising:

first and second cooperating rollers, with said first roller having a fixed axis of rotating;

means for feeding sheets along said feed path between said first and second cooperating rollers;

means for mounting said second cooperating roller so that its axis is movable relative to the fixed axis of said first cooperating roller and so that said second cooperating roller is biased towards said first cooperating roller to enable said second cooperating roller to be displaced away from said first cooperating roller in response to a single or multiple sheet passing between said first and second cooperating rollers;

voltage generating means associated with said second cooperating roller and arranged to produce an output voltage which varies linearly with movement of the axis of said second cooperating roller towards or away from the fixed axis of said first cooperating roller;

circuit means for storing a reference voltage representative of a minimum value of said output voltage during one complete revolution of one of said first and second cooperating rollers when no sheet is passing between said first and second cooperating rollers, the diameter of said one of said first and second cooperating rollers being equal to, or greater than, the diameter of the other one of said first and second cooperating rollers;

subtracting means for subtracting said reference voltage from said output voltage when a single or multiple sheet is passing between said first and second cooperating rollers so as to produce a difference value representative of the thickness of said single or multiple sheet; and data processing means coupled to said subtracting means for providing an indication that a multiple sheet has passed between said first and second cooperating rollers if said difference value continuously exceeds a predetermined value for a period corresponding to at least a predetermined proportion of one complete revolution of said one of said first and second cooperating rollers;

said data processing means having means to sample said difference value a plurality of times at equal intervals when a single or multiple sheet is passing between said first and second cooperating rollers, and also having means to provide an indication that a multiple sheet has passed between said first and second cooperating rollers if at least a predetermined number of consecutive samples of said difference value exceed said predetermined value;

said apparatus also including:

a rotatable timing member which is arranged to rotate in synchronism with said one of said first and second cooperating rollers; and sensor means arranged to generate a series of timing pulses in response to the rotation of said timing member, said sensor means being connected to said data processing means to enable said timing pulses to control the timing of the sampling of said difference value;

said circuit means comprising:

a sample and hold circuit having an output and also having an input to which said output voltage is applied; and comparator means having first and second inputs thereto; the output of said sample and hold circuit being applied to said first input of said comparator means, and a voltage dependent upon said output voltage being applied to said second input of said comparator means;

said sample and hold circuit being effective at the commencement of said revolution of said one of said first and second cooperating rollers when no sheet is passing between said first and second cooperating rollers, to store at its output the voltage appearing at its input, and said comparator means being effective during the remainder of this revolution to cause said sample and hold circuit to store at its output a new lower voltage corresponding to the voltage then appearing at its input if the voltage at said second input of said comparator means falls below the voltage of said first input, the voltage stored at the output of said sample and hold circuit at the completion of this revolution serving as said reference voltage.

5. The apparatus as claimed in claim 4, in which said apparatus also includes a summing amplifier connected between the input of said sample and hold circuit and said second input of said comparator means, said summing amplifier having an output voltage being applied to said second input of said comparator means and also being equal to said output voltage plus a relatively small fixed additional voltage.

6. The apparatus as claimed in claim 5 in which said subtracting means includes a differential amplifier having first and second inputs respectively applied to said input voltage and said reference voltage, said apparatus also including an analog-to-digital converter, with the output of said differential amplifier being connected to said data processing means via said analog-to-digital converter.

7. The apparatus as claimed in claim 6 in which said apparatus further comprises:

a support structure;

a connector member pivotally mounted on said support structure; and a rod having one end fixed in said apparatus and the remaining end thereof being connected to said connector member, with said second cooperating roller being rotatably mounted on said rod;

said connector member being coupled to said voltage generating means to cause a variation in the output voltage of said voltage generating means whenever a single or multiple note passes between said first and second cooperating rollers.

8. The apparatus as claimed in claim 7 in which said voltage generating means includes a linear variable differential transformer having a movable armature, and in which said connector member is connected to said movable armature so that a pivotal movement of said connector member causes said variation in the output voltage of said voltage generating means.

* * * * *

UNITED STATES PATENT AND TRADEMARK OFFICE

CERTIFICATE OF CORRECTION

PATENT NO. : 4,982,947

DATED : January 8, 1991

INVENTOR(S) : Douglas L. Milne

It is certified that error appears in the above-identified patent and that said Letters Patent is hereby corrected as shown below:

Column 12, line 53, delete "outputvoltage" and substitute --output voltage--.

Column 13, line 8, delete "thereof" and substitute --thereon--.

Column 13, line 38, delete "rotating" and substitute --rotation--.

Signed and Sealed this

Eighth Day of September, 1992

*Attest:*

DOUGLAS B. COMER

*Attesting Officer*

*Acting Commissioner of Patents and Trademarks*